US005402502A

United States Patent [19]

Boothroyd et al.

[11] Patent Number: 5,402,502

[45] Date of Patent: Mar. 28, 1995

[54] SOUND OUTPUT SYSTEM

[75] Inventors: Allen Boothroyd, Little Shelford; Michael D. G. Jewitt, Woking; Graeme V. Foy, Worthing, all of United Kingdom

[73] Assignee: Canon Audio Limited, Surrey, United Kingdom

[21] Appl. No.: 99,928

[22] Filed: Aug. 3, 1993

[30] Foreign Application Priority Data

Aug. 20, 1992 [GB] United Kingdom ..... 9217701

[51] Int. Cl.[6] ..... H04R 25/00

[52] U.S. Cl. ..... 381/160; 381/188; 381/205; 181/155; 181/153

[58] Field of Search ..... 381/90, 160, 188, 205; 181/155, 153

[56] References Cited

U.S. PATENT DOCUMENTS

| | | | |
|---|---|---|---|
| 4,051,919 | 10/1977 | Buettner | 381/160 |
| 4,190,739 | 2/1980 | Torffield . | |
| 4,578,809 | 3/1986 | Eberbach | 381/99 |
| 4,640,381 | 2/1987 | Tsuchiya et al. | 181/144 |
| 4,673,057 | 6/1987 | Glassco | 181/144 |
| 4,776,018 | 10/1988 | Cordier | 381/90 |
| 4,805,731 | 2/1989 | Staley | 181/175 |
| 4,907,671 | 3/1990 | Wiley | 381/160 |
| 4,967,872 | 11/1990 | Hart | 181/155 |
| 4,984,653 | 1/1991 | Spors | 181/155 |
| 5,144,670 | 9/1992 | Negishi | 381/160 |

FOREIGN PATENT DOCUMENTS

| | | | |
|---|---|---|---|
| 3424644 | 1/1985 | Germany . | |
| 61-35699 | 2/1986 | Japan | 381/160 |
| 63-74396 | 4/1988 | Japan | 381/188 |
| 2-291798 | 12/1990 | Japan | 381/160 |
| 309162 | 5/1930 | United Kingdom . | |
| 486038 | 8/1937 | United Kingdom . | |
| 479549 | 2/1938 | United Kingdom . | |

OTHER PUBLICATIONS

Tremaine, Audio Cyclopedia, 1979, pp. 1109–1110.

*Primary Examiner*—Forester W. Isen

*Attorney, Agent, or Firm*—Fitzpatrick, Cella, Harper & Scinto

[57] ABSTRACT

A loudspeaker unit is provided for attachment at an elevated position within a listening space. It has a drive unit for producing a beam of treble sound, and a sound mirror that distributes a beam from the sound unit over a wide angular extent both horizontally and vertically with a generally consistent amplitude of perceptible sound. The unit may further comprise an angled mid range and low frequency drive unit. The unit demountably clips into a support bracket that can be carried by a post or fixed directly to the wall. Signal supply is via connectors in the bracket so that as the unit is clipped in place, the electrical connections are established. The speaker is quadrant shaped when viewed in plan and lends itself to installation in groups and clusters (FIG. 13).

14 Claims, 6 Drawing Sheets

SOUND OUTPUT SYSTEM

This invention relates to an audio output system and more particularly to a loudspeaker unit which can be used to produce widely dispersed sound, and if desired can be used in stereo reproduction of sound.

The principle of wide-imaging stereo which is used in a number of loudspeakers being manufactured by the present applicants is disclosed in Patent GB-B-2188811. That patent discloses an acoustic reflector provided opposite to a diaphragm of a drive unit which determines the directivity of the speaker output. The reflector is conical and is located with its axis offset from the axis or centre line of the drive unit so as to produce an asymmetric sound distribution, with most of the mid range and high frequency sound being emitted towards an intended listening direction (hereinafter "forwardly"), but in a wide rather than a narrow distribution.

The use of a pair of right and left speakers and a pair of audio mirrors for respectively controlling the directivities of sounds which are output from the pair of speakers, with the shapes or arrangement of the pair of mirrors being adjusted so that a difference between the arrival times of the sounds which are respectively output from the pair of speakers can be compensated by a sound pressure difference due to the Hass effect in a predetermined area is disclosed in our EP-A-0320270. That specification also discloses that the sound mirror should have concave sides when viewed in profile so as to widen the sound distribution vertically as well as in a horizontal plane.

Our patent specification WO92/07449 discloses a speaker unit having a drive unit fitting within a generally hemispherical housing which is supported cantilever-wise above a generally conical sound mirror. The axis of the drive unit is offset relative to the axis of the sound mirror to enhance the distribution of high frequency and mid range sound forwardly towards a preferred listening direction. The drive unit has concentric first and second diaphragms provided in one embodiment by a parasitic tweeter, and directs a narrow beam of high frequency and mid range sound towards the sound mirror, from which it can be reflected into a room to produce the desired sound distribution. The use of a single drive unit with concentric diaphragms for high frequency and mid range (and optionally also low frequency) sound gives rise to a relatively easily controllable pattern of reflected and diffracted sound. The housing is supported cantilever-wise above the sound mirror on a pair of struts which have lengths greater than their widths and are directed towards the axis of the drive unit so as to minimize their effect on the sound reaching the listener. In the practical form of that speaker, the housing and the sound mirror are separate components between which there is nogas flow path, so that the only gas to provide a reflex load for the drive unit is that in the housing behind the drive unit. The need for a given gas volume to provide an adequate load for the drive unit imposes a minimum size on the enclosure within which that drive unit is contained. A further feature of the practical form of the speaker disclosed in this specification is that the case for the speaker, including the sound mirror, is made of metal which adds to the cost.

In one aspect the invention is based on the realization that a loudspeaker unit having an audio mirror can be attached at an elevated position within a listening space and can be caused to direct a wide beam of treble sound downwardly into the listening space so that a substantial volume of the listening space can be filled with generally uniform high frequency sound from the unit. Such units may be made in a form in which they can be mounted in a corner of the room, or in which they can be abutted together in clusters.

In another aspect the invention provides a loudspeaker unit for attachment at an elevated location within a listening space, the unit having a drive unit for producing a beam of treble sound and a sound mirror that receives the beam from the drive unit and distributes the sound over a wide angular extent horizontally and/or vertically and preferably with a generally constant amplitude of sound as perceived by the listener within the predetermined angular extent.

The aforesaid sound mirror may be arranged to give a distribution of treble sound that extends horizontally about ±45° from an axis defined by the direction of the sound mirror, and wherein the treble sound is distributed through a range of vertical angles extending from the horizontal to about 30° to the horizontal.

In a further preferred aspect the loudspeaker unit may further comprise a low frequency drive unit angled so that when the unit is used in an upright attitude sound is directed obliquely downwards to the listener. The two drive units are then preferably connected to a cross-over unit arranged to direct signals to the first drive unit whose frequency is above the effective lower frequency limit for the sound mirror.

In an alternative aspect there is provided a loudspeaker unit having a bracket into which the unit demountably clips, the bracket having means by which an electrical signal carrying sound to be reproduced can be supplied, and the unit and the bracket having formations that inter-engage to establish an electrical contact between the signal supply means and the unit when the unit is clipped or otherwise fastened into the bracket.

The loudspeaker unit can be used to reproduce sound carried by a high voltage supply line, in which case there may be present in the bracket a transformer for locally reducing the voltage from the supply line. The axis of the loudspeaker unit as defined by the sound mirror and or the drive units present is advantageously at 45° to a pair of walls of the unit so that the unit can conveniently fit into a corner The loudspeaker unit as aforesaid may further comprise means for supporting the unit an abutting relationship to at least one other unit to form a cluster. The units may be assembled in clusters of 2, 3, 4 or 8 and the individual units may be formed into a cluster either in side-by-side relationship or in end-to-end relationship with one of the units being inverted.

The loudspeaker units may further be in the form of quadrants that can abut in side-by-side or end-to-end relationship to form clusters.

Such units may be provided in combination with connector means for carrying a plurality of the units as a cluster and attachment means by which the cluster can depend from an overhead support.

Various embodiments of the invention will now be described by way of example only, with reference to the accompanying drawings, in which.

Figure 1:
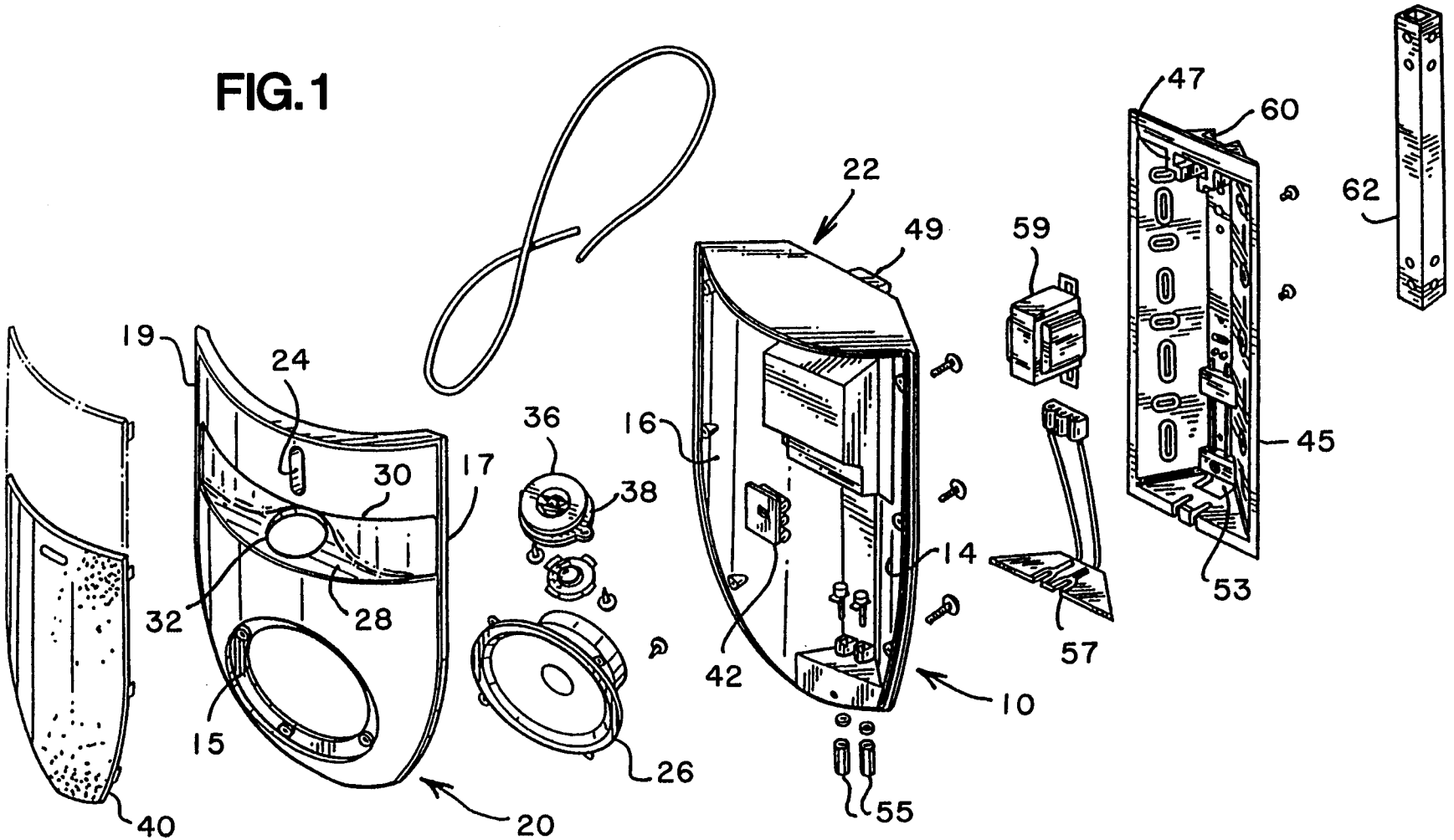
FIG. 1 is an isometric exploded view of a loudspeaker unit, support bracket and support bar according to one form of the invention
Figure 1A:
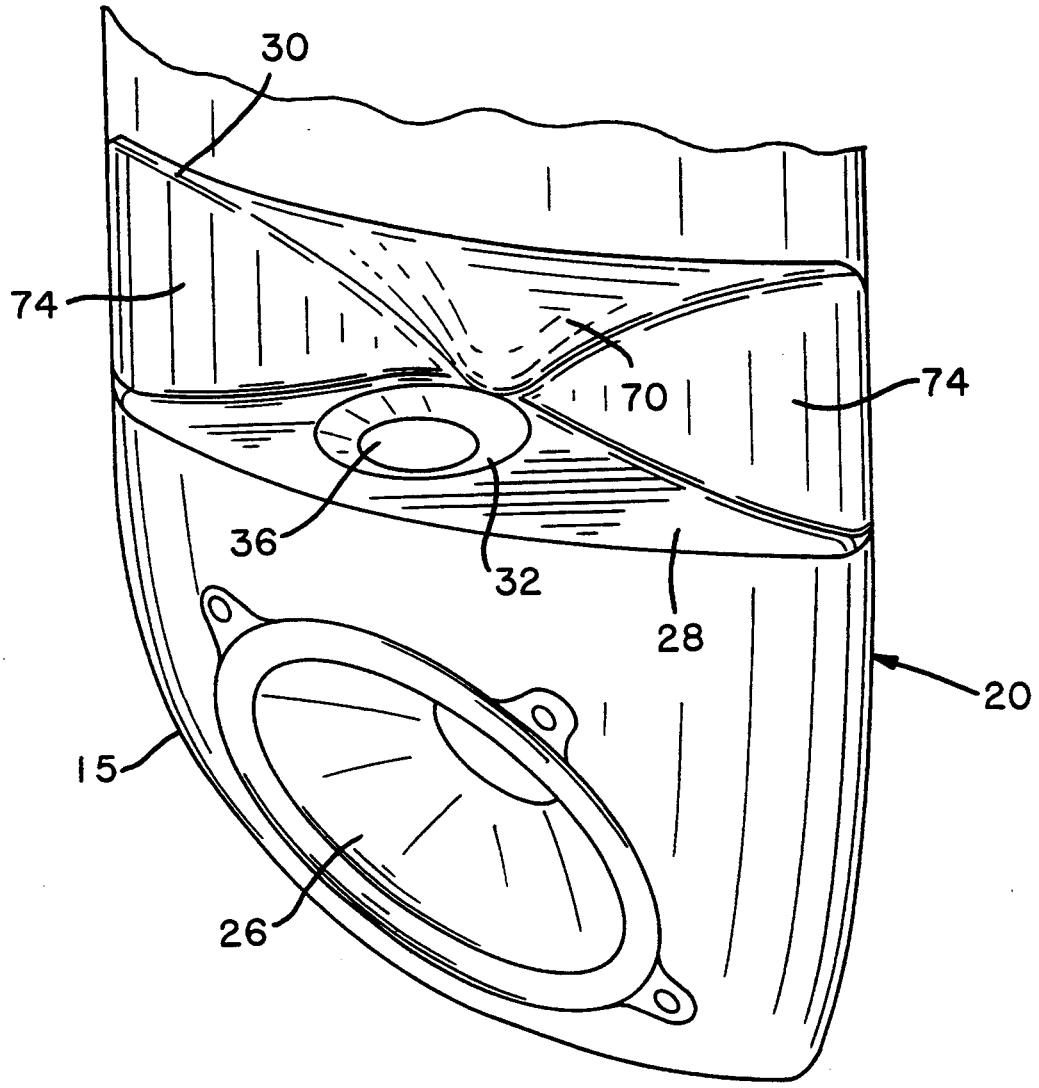
FIG. 1A is a fragmentary isometric view of a region of the unit in a partly assembled state.
Figure 2:
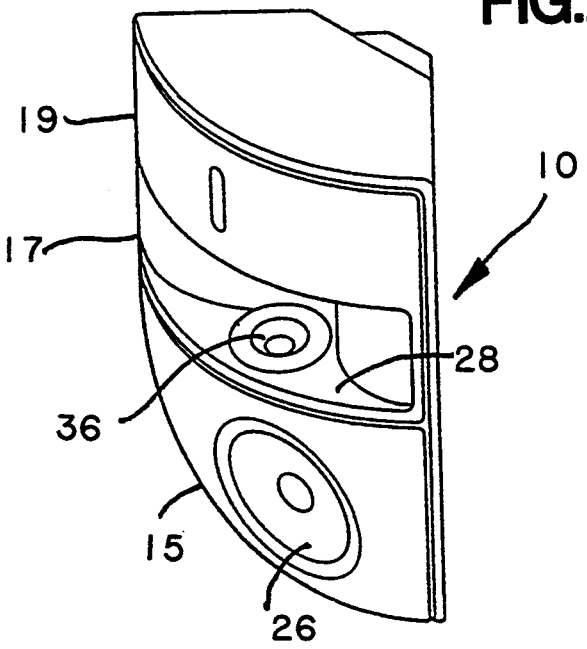
FIG. 2 is an isometric view of the loudspeaker unit with the grill removed.
Figure 3:
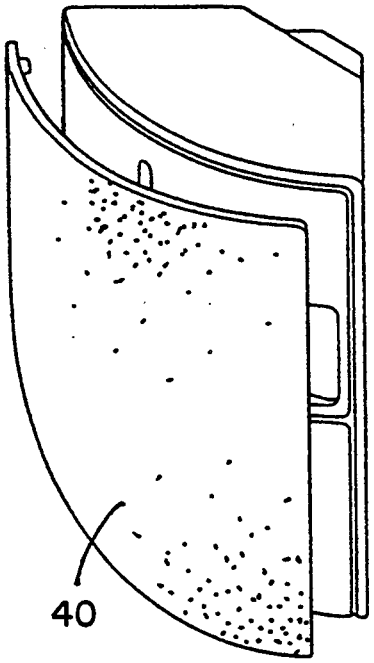
FIGS. 3 and 4 are isometric views of the loudspeaker unit with a full length and half-length grill respectively.
Figure 4:
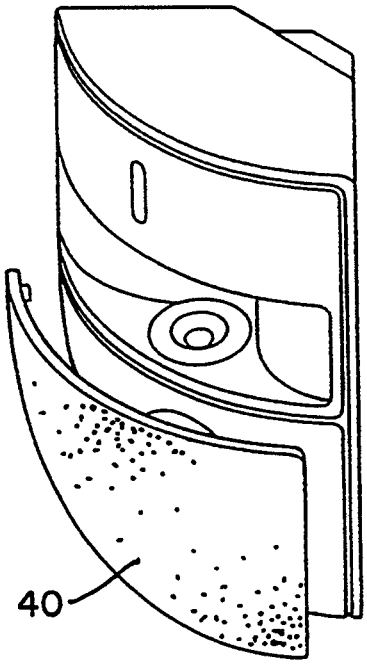

In FIG. 1 there is shown a wide dispersion loudspeaker unit 10 of height about 320 mm. It is suitable for use individually, in stereo imaging pairs or in clusters, including flying clusters of up to eight units and can be driven from an amplifier having a power rating of between 10 and 75 Watts RMS per channel or from a 100V line for distributing sound to speakers within a hotel, restaurant or other public place. Its principal components are a front baffle 20 and a cabinet wall 22 both of molded plastics material within which are housed a 130 mm mid range and bass driver 26 and a 14 mm high frequency driver 36. The reason why plastics materials can be used to form the speaker case is that the drive unit 36 for treble frequencies is separate from the bass drive unit 26 and is not held in cantilever support over the sound mirror, but is supported stably under the sound mirror. The speaker unit has sides 14, 16 directed at right angles to one another to enable the unit to fit within a corner of a room and has the envelope shape of one eighth of a rounded end canister (see FIG. 13 for the shape of a complete canister), that shape being defined by the convexly curved front as shown. It is divided into three regions, with a lower region 15 housing the driver 26 which faces slightly downwards as shown, a central region 17 in which a sound mirror is formed and where the driver 36 is mounted, and an upper region 19 which provides internal volume for tuning of a Helmholtz resonator of the speaker and which has at its front a bass reflex port 24. The terms "upper", "central" and "lower" are defined with reference to the speaker attitude illustrated in FIG. 1, and are not intended to require that the speaker unit should be used in any particular attitude. It is apparent, for example, from the subsequent figures that the unit may be used in an inverted attitude. A grille 40 of perforated metal or other suitable material fits onto the front baffle 20 and may be part of the height thereof (solid lines in FIG. 1; FIG. 4) or the full height thereof (phantom lines in FIG. 1; FIG. 3).

The loudspeaker unit is a demountable fit into a fixing bracket 45 which has its back walls directed at 90° to one another in conformity with the sides 14, 16 of the speaker unit. The fixing bracket 45 may either be attached direct to a wall or it may be supported from a wall or ceiling via a support 62. The bracket 45 has at its upper end a socket formation 47 into which a corresponding key 49 on the back face of the cabinet wall 22 is a sliding fit. At the inner extremity of travel of the unit 10 into the bracket 45, it can move a short distance downwardly relative thereto, which permits a lug at the base of the cabinet wall 22 to fit into socket 53. This enables the unit 10 to be clipped into the bracket 45 and thereafter to be retained without the active intervention of the user. Clamping of the unit in place is completed by tightening lock nuts 55 which establishes an electrical connection between a cross-over network 42 and connectors 57 which fit into the base of the bracket 45. The connectors 57 enable the sound signal to be brought into the unit 10, optionally via line transformer 59 which can also be mounted in the bracket 45.

The back of the bracket 45 has a longitudinal recess 60 which fits onto the side of a support in the form of an optional connector post 62 which may be of indefinite length and enables the units to be connected in side-by-side or end-to-end relationship to provide clusters of from 2 to 8 units and if desired to provide suspended clusters.

The unit 10, which is quarter-circular when viewed in plan, comprises the front baffle 20 which has a lower aperture 15 in which is received the mid range and bass driver 26 and upper and lower transversely directed intermediate walls 28, 30 between which are defined the elements of a sound mirror as described below. The driver 36 is received within a mounting plate 38 by which it is fixed in aperture 32 of the wall 28 opposite to a dispersive surface of the sound mirror. The region of the front baffle 20 above the sound mirror is unobstructed but is provided with a bass reflex port 24 having on its blind face a stub tube defining with a body of gas in the interior of the loudspeaker unit a Helmholtz resonator having a frequency of about 70 Hz that provides a reflex load for the driver 26. The front baffle 20 fits gas-tightly onto the cabinet wall 22, and the space between them which provides the gas volume for the Helmholtz resonator is filled with a light filling of sound damping material to reduce internal reflections within the unit 10. The front grille 40 is a removable push fit onto the front baffle 20. The crossover unit 42 which has a frequency of about 3.5 KHz is fitted between the front baffle 20 and the cabinet wall 22 and is connected to signal input lines and to the drivers 26, 36.

The sound mirror in the central region 17 comprises a downwardly facing quarter-conical sound mirror of concave vertical profile that reflects sound from the driver 36. The axis of the driver 36 is forwardly offset from the axis of the sound mirror 70 with the sound mirror axis approximately coinciding with the rim of the driver 36 so that the sound from the mirror 70 is directed forwardly. The mirror 70 is bounded by and merges smoothly into a pair of convex cylindrical ears 74 that connect the walls 28, 30 and which aid the dispersion of sound. Because of their divergently curved shape the walls 28, 30 do not promote the development of standing waves in the region of the sound mirror 70.

Figure 5:
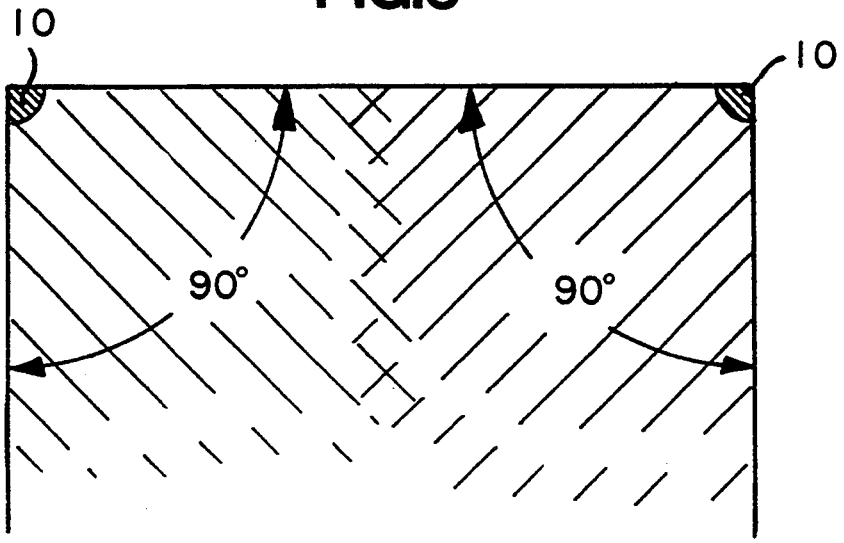
FIGS. 5 and 6 are view illustrating the horizontal and vertical dispersion pattern of high frequency and mid range sound which may be produced by a loudspeaker unit according to the invention.
Figure 6:
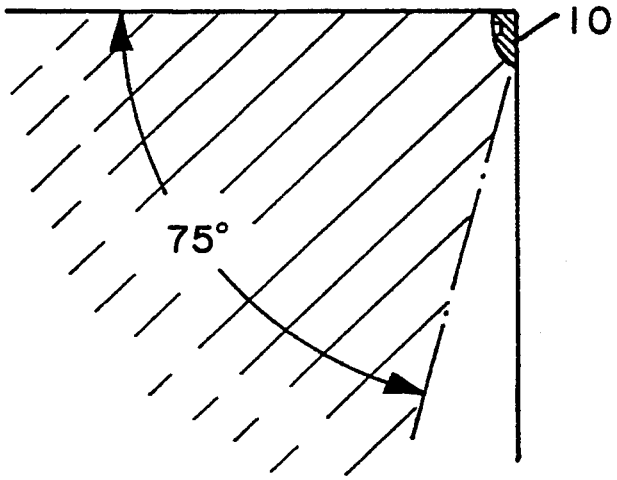

The distribution of treble sound to which the above drive unit gives rise is apparent from FIGS. 5 and 6. The use of the off-centre acoustic mirror 70 may enable listeners with a generally ±45° angle either side of the unit and up to 75° below to hear the full bandwidth of the programmed material. The off-axis treble and mid-range inaccuracies of conventional loudspeakers are avoided. In a conventional loudspeaker, as the frequency rises, the sound becomes more directional, so that the treble is heard most loudly at the front of the loudspeaker, and the intensity at frequencies of 2.5 kHz or above declines as the listening point moves off-axis. The present loudspeaker unit reduces this off-axis loss of treble by dispersing at least the higher treble frequencies by means of the sound mirror 70. The low frequency and mid range sound which is generally not directional is reproduced by the drive unit 26 and becomes widely dispersed through the listening space. The cut-off frequency below which the sound is insufficiently directional to be dispersed by the sound mirror 70 is below the cut-off frequency of the crossover unit 42. The high frequency driver 36 therefore produces directional sound which becomes widely dispersed by the mirror 70, so as to minimize the development of "dead" areas or "hot:" spots, and because it may produce a wide and relatively uniform distribution of sound, it can be positioned within the listening space with less regard to acoustics and more regard to convenience and aesthetics.

The shape provided for the individual units 10, and the way in which they are attached to their support when in use, enables the unit to be installed in a wide range of different ways to meet different user requirements. These requirements may be classified firstly into installations designed to produce stereo sound or surround sound and in which the speakers cooperate in pairs or groups to provide a sound image, and secondly into installations where the speakers can be used to provide background monophonic sound in a restaurant or other public place. In the latter case the units 10 are distributed individually through the space to provide a required level of sound, and are fed with a monophonic signal. These various possibilities are illustrated in FIGS. 7 to 13.

Figure 7:
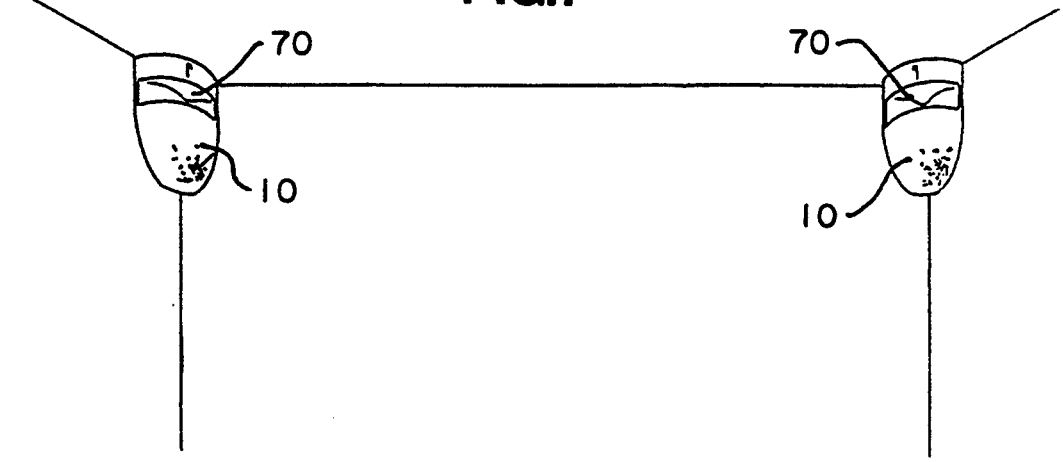
FIG. 7 shows a pair of the loudspeaker units in corners of a room.
Figure 8:
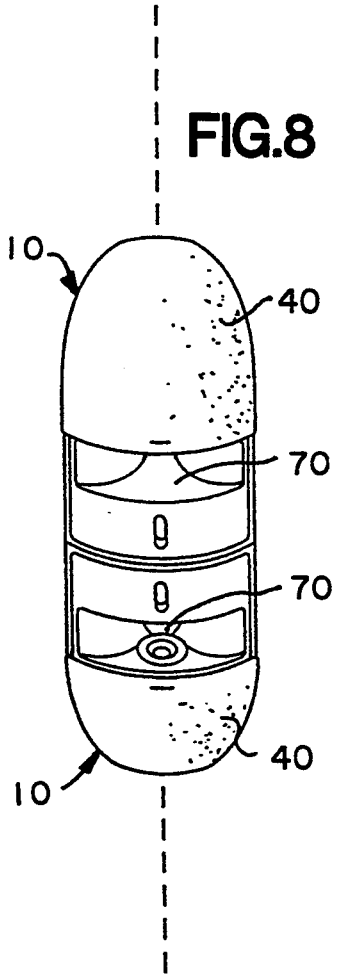
FIG. 8 shows a cluster of two of the loudspeaker units in a corner of a room.
Figure 9:
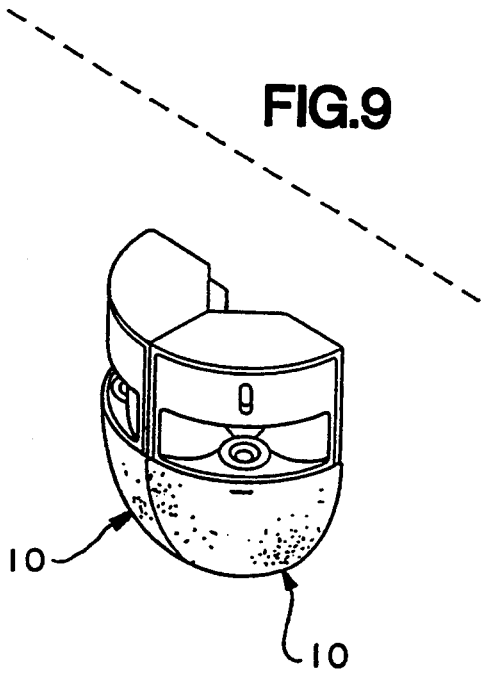
FIG. 9 shows a cluster of two of the loudspeaker units on a wall.
Figure 10:
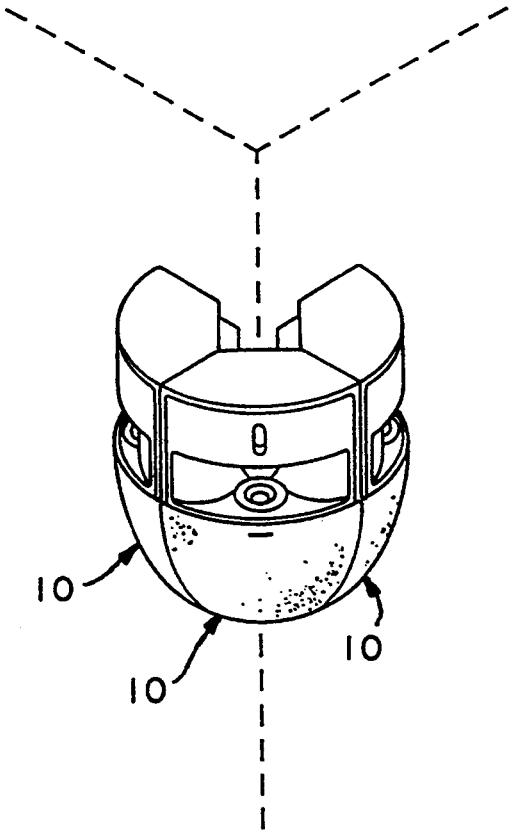
FIG. 10 shows a cluster of three of the loudspeaker units on an external corner.
Figure 11:
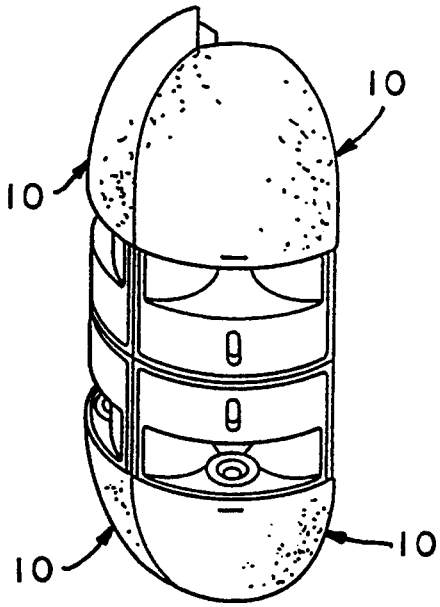
FIG. 11 shows a cluster of four of the loudspeaker units for fitting onto a wall.
Figure 12:
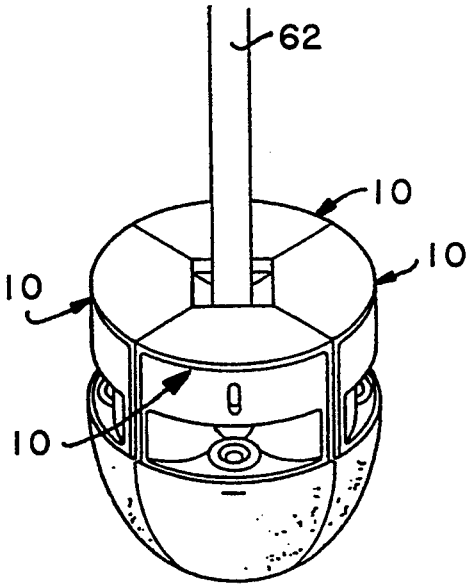
FIG. 12 shows a suspended cluster of four of the loudspeaker units.
Figure 13:
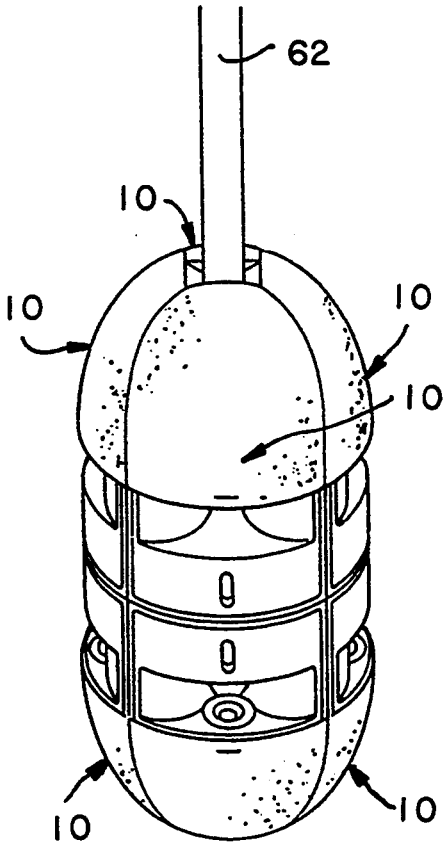
FIG. 13 shows a suspended cluster of eight of the loudspeaker units.

In FIG. 7 a pair of the loudspeaker units 10 are ceiling-mounted in the corners of the room to provide a stereo installation. In FIG. 8 a cluster of two of the loudspeaker units 10 is provided at a right-angled corner between two walls of a tall room. In this arrangement the two units 10 are superimposed with the upper unit being in an inverted attitude. In FIG. 9 there is again a cluster of two of the units 10 in side-by-side relationship on a wall. In FIG. 10 there is provided a cluster of three of the units 10 in side-by-side relationship on an external corner of a room or building, e.g., a small building such as a kiosk within a much larger building such as a railway station or airport. In FIG. 11 there is shown a cluster of four of the units 10 to fit flat on a wall, the lower two units being in an upright attitude and the upper two units being in an inverted attitude. In FIG. 12 there is a provided a cluster of four of the units 10 in side-by-side relationship suspended from an overhead attachment point. In FIG. 13 there is shown a cluster of eight of the speaker units again suspended by means of a post from an overhead attachment point.

We claim:

1. A loudspeaker unit, comprising:

a drive unit for producing and outputting a beam of treble sound, said drive unit having a central axis along which the beam is output;

a sound mirror for reflecting the beam of treble sound, said sound mirror having a first reflecting surface disposed opposite to said drive unit and including means for deflecting the beam of treble sound downwardly, said sound mirror also having a second reflecting surface defining a lateral opening for reflecting the beam of treble sound laterally; and a loudspeaker cabinet for housing said drive unit and said sound mirror, said cabinet having first and second lateral side walls extending in planes transverse to each other and subtending an angle substantially corresponding to the lateral opening defined by said second reflecting surface.

2. A loudspeaker unit according to claim 1, wherein said first and second lateral side walls of said loudspeaker unit extend in planes substantially perpendicular to each other.

3. A loudspeaker unit according to claim 1, wherein a longitudinal axis of said first reflecting surface is offset from the central axis of said drive unit.

4. A loudspeaker unit as set forth in claim 3, wherein the central axis of said drive unit is positioned in front of the longitudinal axis of said first reflecting surface with respect to said loudspeaker cabinet.

5. A loudspeaker unit as set forth in claim 1, wherein said second reflecting surface of said sound mirror reflects the beam of treble sound in a lateral range of approximately 90°.

6. A loudspeaker unit according to claim 1, wherein said first reflecting surface of said sound mirror reflects the beam of treble sound in a downward vertical range of approximately 75°.

7. A loudspeaker unit, comprising:

a drive unit for producing and outputting a beam of treble sound, said drive unit having a central axis along which the beam is output;

a sound mirror for reflecting the beam of treble sound, said sound mirror including a deflecting surface disposed opposite to said drive unit and having a convex portion with a longitudinal axis of symmetry, said sound mirror also having a second reflecting surface defining a lateral opening for reflecting the beam of treble sound laterally; and a loudspeaker cabinet for housing said drive unit and said sound mirror, said cabinet including first and second lateral side walls extending in planes transverse to each other and subtending an angle substantially corresponding to the lateral opening defined by said second reflecting surface.

8. A loudspeaker unit according to claim 7, wherein said first and second lateral side walls of said loudspeaker unit extend in planes substantially perpendicular to each other.

9. A loudspeaker unit according to claim 7, wherein the longitudinal axis of said convex portion is offset from the central axis of said drive unit.

10. A loudspeaker unit as set forth in claim 9, wherein the central axis of said drive unit is positioned in front of the longitudinal axis of said convex portion with respect to said loudspeaker cabinet.

11. A loudspeaker unit as set forth in claim 7, wherein said second reflecting surface of said sound mirror reflects the beam of treble sound in a lateral range of approximately 90°.

12. A loudspeaker unit according to claim 7, wherein said convex portion reflects the beam of treble sound in a downward vertically range of approximately 75°.

13. A loudspeaker and mounting bracket therefor, comprising:

a loudspeaker unit including means for producing and outputting sound and a loudspeaker cabinet for housing said sound producing means; and a fixing bracket for removably mounting said loudspeaker cabinet, said fixing bracket including electrical connectors for receiving and transmitting an electrical power source, wherein said loudspeaker cabinet is mountable to said fixing bracket and includes means for receiving the electrical power source when mounted therein, and wherein said loudspeaker cabinet includes first and second lateral side walls, and said fixing bracket includes first and second lateral side walls, with said lateral side walls of said fixing bracket subtending an angle substantially corresponding to said first and second lateral side walls of said loudspeaker cabinet.

14. A loudspeaker and mounting bracket as set forth in claim 13, further comprising fixing means for fixing said fixing bracket to a stationary object.

* * * * *

UNITED STATES PATENT AND TRADEMARK OFFICE

CERTIFICATE OF CORRECTION

PATENT NO. : 5,402,502

DATED : March 28, 1995

INVENTOR(S) : Boothroyd et al.

It is certified that error appears in the above-indentified patent and that said Letters Patent is hereby corrected as shown below:

COLUMN 1:

Line 57, "nogas" should read --no gas--.

COLUMN 4:

Line 66, "programmed" should read --program--.

COLUMN 5:

Line 17, "hot:" should read --"hot"--.

Signed and Sealed this

Eleventh Day of July, 1995

*Attest:*

Bruce Lehman

BRUCE LEHMAN

*Attesting Officer*

*Commissioner of Patents and Trademarks*